United States Patent [19]

Skov

[11] Patent Number: 4,850,347

[45] Date of Patent: Jul. 25, 1989

[54] FACE MASK

[75] Inventor: Martin R. Skov, Kr. Reutlingen, Fed. Rep. of Germany

[73] Assignee: Metric Products, Inc., Culver City, Calif.

[21] Appl. No.: 28,308

[22] Filed: Mar. 20, 1987

Related U.S. Application Data

[62] Division of Ser. No. 157,522, Jun. 9, 1980, abandoned.

[51] Int. Cl.[4] ..... A62B 7/16

[52] U.S. Cl. ..... 128/206.16; 128/206.19

[58] Field of Search ..... 128/206.12, 206.17, 128/206.19, 206.24, 205.29, 205.27, 205.28; 55/495, 502, 514, DIG. 5; 264/257, 258, DIG. 48; 425/500, 503, 506, 507, 508, 509, 520, 521, 816

[56] References Cited

U.S. PATENT DOCUMENTS

| | | | |
|---|---|---|---|
| 3,586,565 | 12/1968 | Fielding | 425/509 |
| 3,695,799 | 10/1972 | Held, Jr. | 425/506 |
| 3,757,777 | 9/1973 | Kaufman | 128/206.19 |
| 4,319,567 | 3/1982 | Magidson | 128/206.19 |
| 4,600,002 | 7/1986 | Yanek et al. | 128/206.19 |

FOREIGN PATENT DOCUMENTS

| | | | |
|---|---|---|---|
| 2717968 | 12/1977 | Fed. Rep. of Germany | 128/206.19 |
| 2433952 | 3/1980 | France | 128/206.19 |
| 8101019 | 4/1981 | PCT Int'l Appl. | 128/206.12 |
| 2077112 | 6/1980 | United Kingdom | 128/206.12 |
| 2103491 | 8/1981 | United Kingdom | 128/206.19 |

*Primary Examiner*—Max Hindenburg
*Assistant Examiner*—K. M. Reichle
*Attorney, Agent, or Firm*—Charles H. Schwartz; Ellsworth R. Roston

[57] ABSTRACT

A face mask to be worn upon the face of a wearer and for providing filtering of particular impurities in the air, including at least one layer of flexible plastic material molded generally to conform to the contours of the face of the wearer and forming a flexible support carrier for filter material and with the one layer formed of open-work flexible plastic material for providing a plurality of perforations through the first layer for allowing the free passage of air through the one layer, and a separate layer of filter material supported by the one layer of flexible plastic material and with the filter material filtering out the particular impurities in the air.

12 Claims, 3 Drawing Sheets

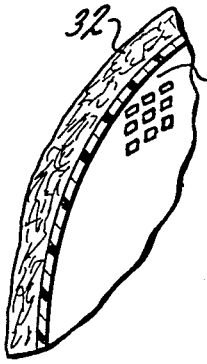
Fig. 4
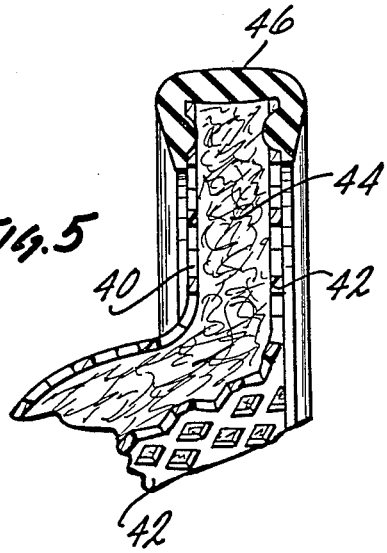
Fig. 5
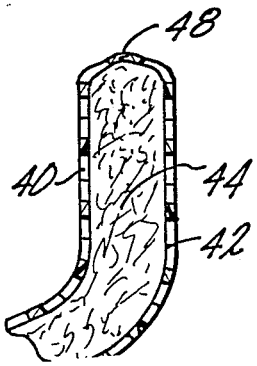
Fig. 6
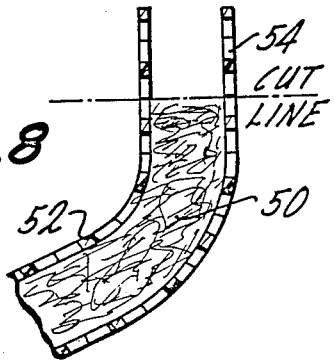
Fig. 8
Fig. 7
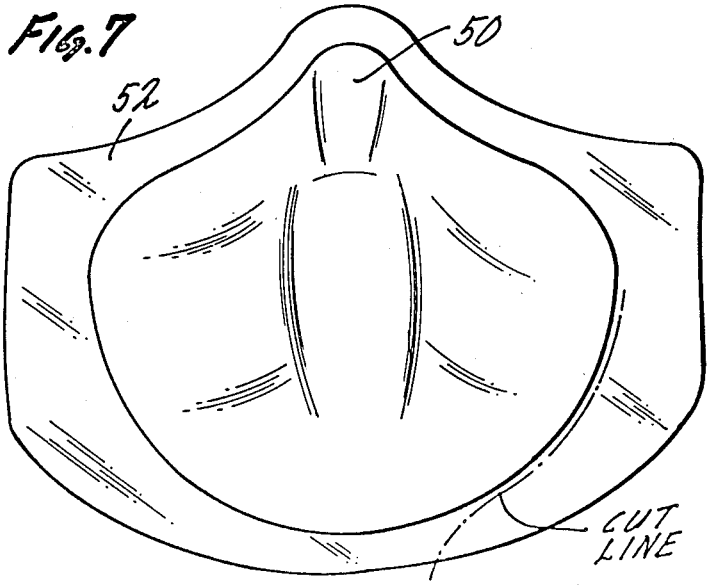
Fig. 9
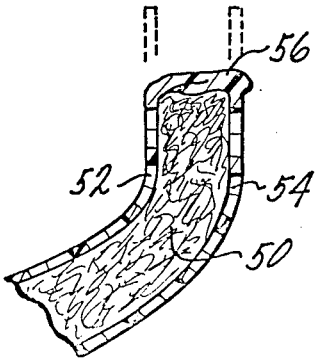

FACE MASK

This is a division of application Ser. No. 157,522, filed June 9, 1980, now abandoned.

The present invention relates to face masks and in particular to face masks formed from a plurality of layers and with the individual layers serving different functions. In the face mask of the present invention, at least one layer is formed of an openwork flexible plastic material and serves as a support layer for carrying at least another layer of filter material. In a particular embodiment of the invention, a pair of layers of openwork flexible plastic material form the support for the filter layer, and with the layer of filter material sandwiched in between the layers of openwork plastic material.

With the face mask of the present invention, the use of the openwork plastic material provides for a flexible yet shape-retaining carrier support for the filter material. Moreover, since the plastic material has an openwork configuration which provides for a plurality of perforations, the openwork plastic material allows for the generally unrestricted passage of a high volume of air. Since the openwork plastic allows for the passage of a high volume of air, the face mask of the present invention is comfortable to wear since the breathing of the wearer is not unduly restricted. The layer of filter material may be of any of the general types of filter material commonly used with face masks for providing for the filtering of particular impurities in the air. With the face mask of the present invention, the filter material may be relatively thick and yet still be properly supported by the carrier layers of openwork plastic. In addition, the filter material currently used may not be shape retaining or self supporting, so it is necessary to use some sort of carrier means to provide for the support of the filter material.

In the face mask of the present invention, the openwork plastic material may be formed from a plastic sheet which has a pattern of openings or may be formed from a sheet of woven material or may be formed from a sheet of mesh material. In particular, the openwork plastic layer may be formed from various plastic materials such as vinyl, polyethylene, synthetic or real rubber or other materials or combinations of materials. As an example, the openwork plastic layer has been formed from ethyl vinyl acetate.

The filter material may be formed from various types of filter materials, such as non-woven polyester fiber, electrostatically charged polypropylene, activated charcoal, various types of natural fibers and other filter materials currently used. Many of the filter materials currently used to provide the filter portion of face masks cannot stand a high degree of heat since the heat may reduce or eliminate the filtering properties of the material. With the present invention, the face mask may be formed using a method which does not subject the filter material to a high degree of heat, so that the filtering properties of the filter material are not substantially affected.

In a first particular embodiment of the present invention, the face mask is formed from four layers of material and specifically includes a pair of openwork flexible plastic layers serving to support a layer of filter material in between the openwork plastic layers. A fourth inner layer of a soft material serves as a layer positioned against the face of the wearer of the mask. This soft material provides additional comfort to the wearer of the face mask. As an example, a material such as nylon tricot may serve as the layer of soft material. In another embodiment of the invention, a single sheet of openwork flexible plastic is formed to carry and to act as a support for a layer of filter material.

The present invention may also include various additional means to provide a seal along the peripheral edge of the face mask. For example, a separate gasket may be attached around the peripheral edge, such as by molding, to seal the peripheral edge of the face mask and also to seal the edge of the face mask against the face of the wearer of the mask. Other means for sealing the peripheral edge of the face mask include cutting with a hot blade the layers of the face mask to the desired outer configuration so as to melt the openwork plastic layers at the peripheral edge and thereby provide for a sealing of the peripheral edge.

In another embodiment of the invention, the filter material is precut to a desired filter configuration. The layers of openwork plastic extend past the precut filter material and when the openwork plastic layers are cut with a hot blade, the peripheral edge portions of the layers of openwork plastic material are bonded together to provide for an edge seal for the face mask of the present invention. Also, the peripheral edge portions of the openwork plastic layers may be rolled or molded to provide a gasket if desired.

The present invention also provides for a method of molding a multilayer face mask to a desired configuration to conform to the contours of the wearer of the mask and wherein the filter material experiences a minimum of heat so as to prevent damage to the filter material. Specifically, the sheets of openwork plastic material are preheated at a position remote from the filter material. The sheets of openwork plastic material are then inserted between male and female mold members and with the filter material also inserted at the same time between the preheated sheets of openwork plastic material.

The male and female mold members are maintained at a low temperature and when the male and female mold members are brought together to mold the face mask to the desired contour configuration, the sheets of openwork plastic material which have been softened by the preheating are both molded and quickly reduced in temperature. The use of this cold molding technique prevents the filter material from experiencing any substantial amount of heat. In the method described above, the filter material may also be precut to a desired configuration so that after the face masks are molded the layers of openwork plastic material extend past the precut configuration for the filter material.

The present invention therefore is directed to a face mask which allows for the use of different types of filter material to provide for the desired degree of filtering while at the same time allowing for a considerable volume of air to pass to the wearer of the mask. The face mask of the present invention includes at least a single layer of openwork flexible plastic material supporting and carrying at least one layer of filter material. The face mask of the present invention may include an additional layer of openwork plastic material to provide for additional support and an additional layer of a soft fabric material to provide for comfort. The present invention includes various means for sealing the peripheral edge of the face mask. The present invention is also directed to a particular method of molding the face mask and uses a cold molding technique so as to prevent any heat damage to the filter material. A clearer understanding of the present invention will be had with reference to the following description and drawings wherein:

FIG. 4 is a side cross-sectional view of a portion of a second embodiment of the face mask of the present invention;

FIG. 5 is a side cross-sectional view of a portion of a third embodiment of the face mask of the present invention and including a gasket forming an edge seal;

FIG. 6 is a side cross-sectional view of the portion of the third embodiment of the face mask including alternate means forming an edge seal;

FIG. 7 is a fourth embodiment of a face mask of the present invention using a precut filter member;

FIG. 8 is a side cross-sectional view of a portion of the face mask of FIG. 7;

FIG. 9 is a side cross-sectional view of the portion of the face mask of FIG. 7 with an edge seal.

Figure 1:
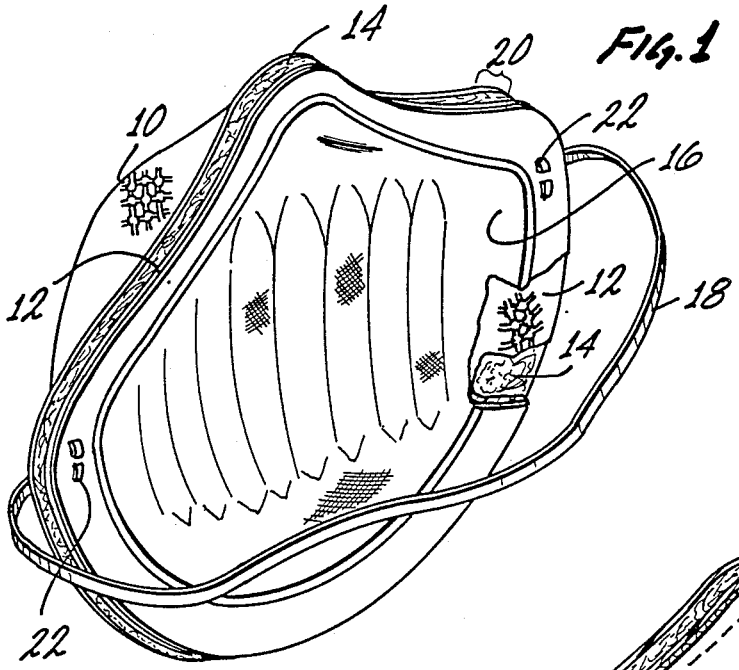
FIG. 1 is a perspective view of a first embodiment. of a face mask constructed in accordance with the teachings of the present invention.
Figure 3:
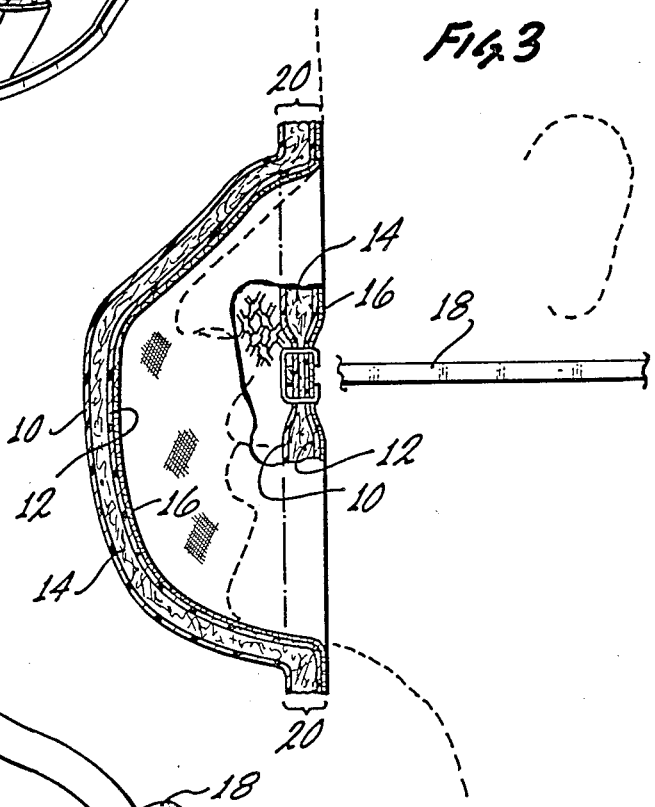
FIG. 3 is a side cross-sectional view taken along lines 3—3 of FIG. 2.
Figure 2:
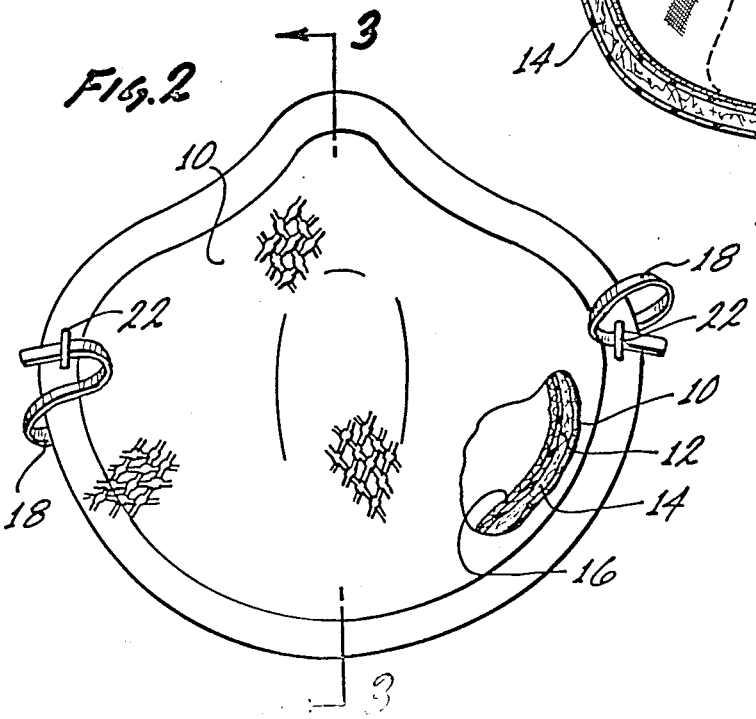
FIG. 2 is a front view of the first embodiment of the invention.

FIGS. 1 through 3 illustrate a first embodiment of the face mask of the present invention, which face mask includes four layers of material. Specifically, a pair of openwork flexible plastic layers 10 and 12 sandwich a layer of filter material 14. A layer of a soft fabric 16 is positioned on the inside surface of the face mask and provides for additional comfort for the wearer of the face mask. An elastic band 18 may be attached by staples 22 and is used to support the face mask in position against the face, as shown in FIG. 3.

The openwork plastic layers 10 and 12 provide for support layers to carry the filter material 14. In particular, the openwork plastic layers may be formed from sheets which have a plurality of openings therethrough to permit the free passage of air. For example, the openwork plastic layers may be formed from a perforated plastic material, a woven plastic material, a mesh plastic material, etc. In general, the plastic material is of the type that can be molded to a desired contour configuration and will retain that configuration so as to support the filter material, yet at the same time being flexible enough to allow for the face mask to conform to different facial contours of individual wearers of the mask. Specifically, the openwork plastic layers may be composed of various types or combinations of plastic materials such as vinyls, polyethylenes, synthetic or real rubber, etc., which allow for moldability to form the desired configuration yet with flexibility to allow for the shaped mask to fit the face of individual wearers.

The filter layer 14 may be formed from any of the known types of filter materials such as non-woven polyester fiber material, electrostatically charged polypropylene, activated charcoal, various natural fibers such as merino wool, or other types of materials used for filtering. Many of these different types of filter material cannot withstand high heat, since the high heat would tend to destroy the filtering properties of the material. The present invention provides for a method of forming the face mask wherein the filter layer 14 is not subjected to high heat.

In the first embodiment of the face mask shown in FIGS. 1 through 3, an inner layer of a soft fabric is provided for comfort. This layer may be formed of material such as nylon tricot which will adhere to the inner layer of openwork plastic during the molding process. As shown in FIGS. 1 through 3, the edge portion 20 extending around the periphery of the mask is left open. As indicated above, the elastic band 18 may be attached to the edge portion using staples 22, and these staples 22 will also staple the layers together at two side positions. If desired, additional staples may be placed around the periphery of the face mask.

Since the face mask of the present invention is generally not intended to be subjected to repeated wearing, then the edge portion need not be sealed. Additionally, the various layers during the molding process are to some degree adhered to each other. However, other embodiments of the face mask of the present invention show various means for sealing the peripheral edge portion of the face mask. This additional sealing may also provide for a closer fitting of the mask to the face of the wearer.

FIG. 4 illustrates a portion of a second embodiment of the face mask of the present invention and in particular shows a face mask having the simpler construction than the first embodiment and includes just two layers of material. Specifically, in the embodiment of FIG. 4, a first inner layer of openwork flexible plastic material 30 forms a support carrier for a second layer of filter material 32. The layers 30 and 32 may be constructed using the materials described above, and an elastic band may be attached so as to hold the face mask in position.

It is to be appreciated that the embodiment of FIG. 4 contemplates the use of filter material 32, which will at least to some degree adhere to itself since the filter material is not sandwiched between two layers of plastic material. It is also to be appreciated that the relative positions of the layers 30 and 32 may be reversed and with the filter material on the inside. As an example, if the layer of filter material 32 is formed from a natural fiber, such as merino wool, then this layer may be comfortably positioned against the face of the wearer. Since the embodiment of the face mask shown in FIG. 4 is simpler in construction and materials, it would be less costly than the embodiment shown in FIGS. 1 through 3. However, the face mask of FIG. 4 would not be able to withstand the same degree of wear as the embodiment of FIGS. 1 through 3.

FIG. 5 illustrates a portion of a third embodiment of the face mask of the present invention including a pair of openwork flexible plastic support layers 40 and 42 receiving a layer of filter material 44 therebetween. In the embodiment of FIG. 5, the edge portion of the face mask is sealed by an attached soft molded gasket member 46. The gasket member 46 not only provides for a seal of the edge portion, thereby preventing the layers from separating, but also the gasket 46 may provide for a tighter seal of the mask against the face of the wearer. The gasket member may be attached to the edge portion of the molding or may be molded in place.

FIG. 6 illustrates a face mask having the same general structure as the mask of FIG. 5 and including the pair of layers of openwork flexible plastic material 40 and 42 supporting the layer of filter material 44 therebetween. The mask of FIG. 6 includes a different means for providing an edge seal. Specifically, in the face mask of FIG. 6, the peripheral edge portion 48 has been cut with a hot blade, which melts the plastic material forming the layers 40 and 42 and thereby runs into the peripheral edge of the filter layer 44. This melting of the plastic material provides for a bond of the various layers along the peripheral edge portion 48 to prevent the layers from separating. It is to be appreciated that the embodiments of the invention shown in FIGS. 4, 5 and 6 may each include a layer of a soft fabric on the interior surface of the mask. Also, the use of a separate gasket member or a melting of the plastic material may also be used to provide for an edge seal in the embodiments of the invention shown in FIGS. 1 through 4.

FIGS. 7 through 9 illustrate a fourth embodiment of the invention using a precut filter layer 50, which is disposed within a pair of overlaying openwork plastic layers 52 and 54. As can be seen in FIGS. 7 and 8, the peripheral portions of the plastic layers 52 and 54 extend past the precut layer 50 of filter material after the layers are formed into the face mask. As shown in FIG. 9, the peripheral portions of the layers 52 and 54 may be cut with a hot blade, as described above, or may be rolled over or molded into a bead of plastic material. The bead 56 of plastic material provides an edge seal for the face mask and may also provide for a tighter seal of the mask against the face of the wearer.

Figure 10:
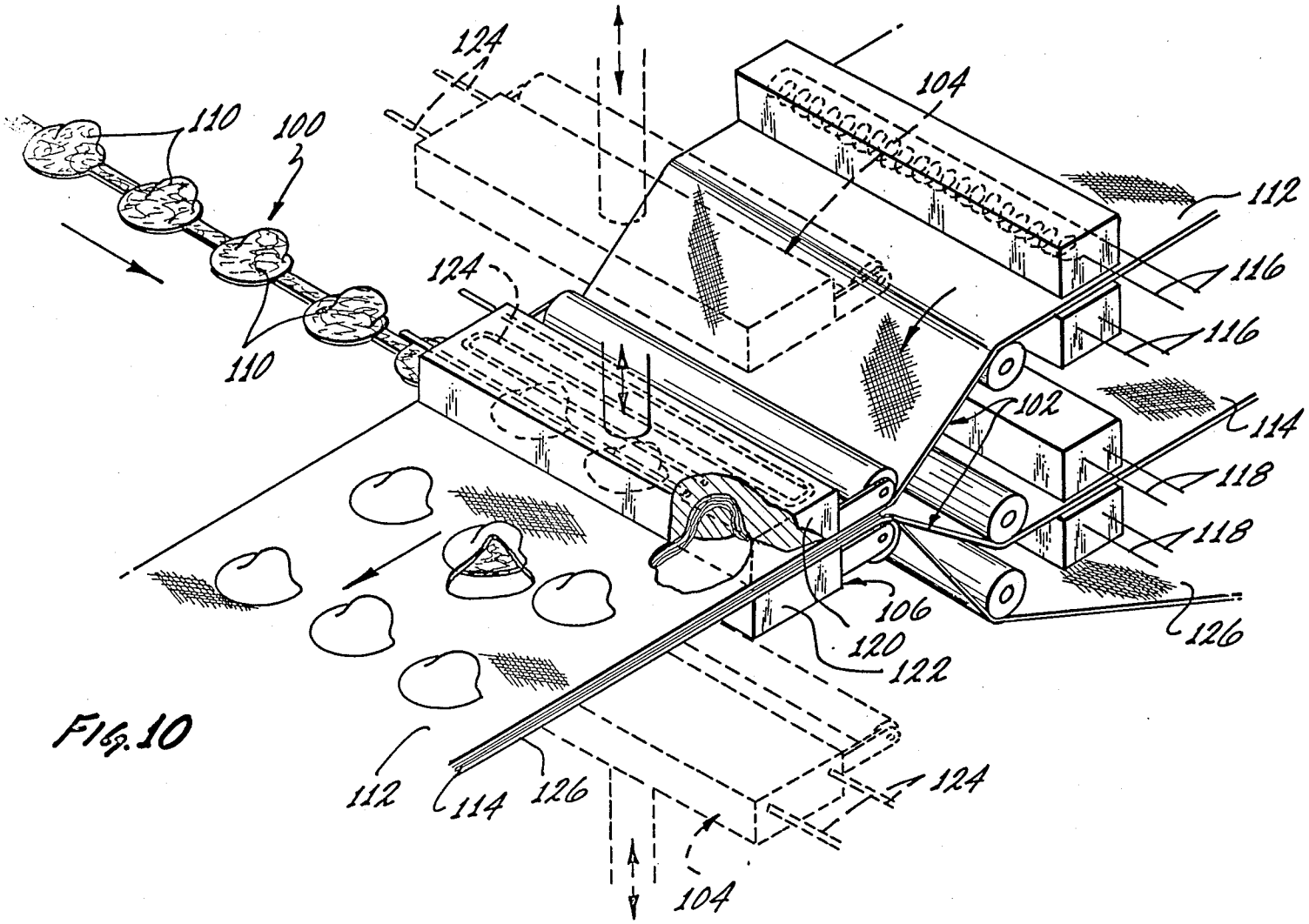
FIG. 10 illustrates a method for forming the face mask of the present invention.

FIG. 10 illustrates a method of making the face mask of the present invention and specifically a method of molding the face mask to the desired contour configuration without subjecting the filter material to a high degree of heat which might damage the filter material. In the method as shown in FIG. 10, filter material 110 may be provided in sheets or may be precut, as shown by step 100. The precut filter material 110 is to be inserted between top and bottom sheets of plastic material, but first the top and bottom sheets 112 and 114 of plastic material are subjected to a preheating to soften the plastic material. As an example, the plastic sheets may be preheated to 285° F.±15°. This is shown by step 102, using heaters 116 and 118. The preheated top and bottom sheets of plastic material are to be inserted between male and female molds 120 and 122 which are maintained at a low temperature by refrigerator apparatus 124. For example, the molds 120 and 122 may be maintained at 35° F.±5°. The precut filter material 110 is also to be inserted in the proper position between the male and female molds 120 and 122 and between the top and bottom sheets 112 and 114. Additionally, soft fabric 126 may be inserted between the male mold and one sheet of preheated plastic. This is shown in step 104.

In the next step, the molds, which are maintained at a cold temperature, are brought together to capture the top and bottom sheets of plastic material 112 and 114, the precut filter material 110 and the fabric 126, so as to provide for molding of individual face masks. The use of the cold molds provides for the top and bottom sheets of plastic material to be cooled at the same time they are molded to the desired contour configuration. In this way, a relatively low degree of heat is transferred to the filter material, yet allowing the face masks to be properly molded. All of the particular embodiments of the face mask described above may be made by the method desired as long as at least one layer of the openwork flexible plastic material is used to carry and support the filter material so as to allow for a high volume of air to pass through the opening in the openwork plastic material.

As a final step, the individual face masks may be cut from the large sheets and the edges may be sealed either using a separate gasket, as shown in FIG. 5, or by sealing the edge with a hot blade, as shown in FIGS. 6 and 9.

The present invention, therefore, provides for an improved face mask providing for both desirable filter characteristics yet allowing the masks to conform to the configuration of the face of the wearer and also allowing for a relatively high volume of air to pass through the mask to the wearer of the mask.

Although the invention has been described with reference to particular embodiments, it is to be appreciated that various adaptations and modifications may be made, and the invention is only to be limited by the appended claims.

I claim:

1. A method of making a face mask to be worn upon the face of a wearer and for providing filtering including the following steps, providing at least one layer of flexible plastic material formed from openwork flexible plastic material for providing a plurality of perforations for allowing for the free passage of air through the openwork plastic, providing a layer of filter material for filtering impurities in the air, providing male and female molding members having a mold configuration conforming generally to the contours of the face of the wearer, maintaining the molding members at a cold temperature, preheating the at least one layer of openwork flexible plastic material to a hot temperature sufficient to mold the plastic material to a desired configuration, moving the preheated layer of openwork flexible plastic material and the layer of filter material between the cold male and female molding members, and pressing the male and female molding members together to form the face mask to the desired configuration by molding the at least one layer of openwork flexible plastic material to form a support layer to carry the layer of filter material while at the same time cooling the preheated layer of openwork flexible plastic material sufficiently so as not to damage the layer of filter material.

2. The method of claim 1 wherein two layers of openwork flexible plastic material are provided and preheated and wherein the layer of filter material is sandwiched between the layers of openwork flexible plastic when the male and female molding members are pressed together.

3. The method of claim 2 additionally including the step of providing a layer of soft fabric and moving the layer of soft fabric between the molding members at a position intermediate the male molding member and one of the two layers of open work flexible plastic material for covering the inner surface of the face mask.

4. The method of claim 2 additionally including the step of heating the peripheral edges of the layers of openwork flexible plastic to seal the peripheral edge of the face mask.

5. The method of claim 2 additionally including the step of precutting the layer of filter material to a particular configuration and the layers of openwork flexible plastic molded to extend past the periphery of the filter material.

6. The method of claim 5 additionally including the step of bonding the peripheral edges of the layers of openwork flexible plastic material together at a position past the periphery of the filter material to form a bead.

7. The method of claim 2 additionally including the step of attaching a gasket around the peripheral edge of the face mask.

8. The method of claim 1 additionally including the step of providing a layer of soft fabric and moving the layer of soft fabric between the molding members at a position intermediate the male molding member and the filter material for covering the inner surface of the face mask.

9. The method of claim 1 additionally including the step of heating the peripheral edge of the at least one layer of openwork flexible plastic material to seal the peripheral edge of the face mask.

10. The method of claim 1 additionally including the step of precutting the layer of filter material to a particular configuration and the at least one layer of openwork flexible plastic molded to extend past the periphery of the filter material.

11. The method of claim 10 additionally including the step of heating the peripheral edge of the at least one layer of openwork flexible plastic material at a position past the periphery of the filter material to form a bead.

12. The method of claim 1 additionally including the step of attaching a gasket around the peripheral edge of the face mask.

* * * * *